219-121 SR
PTU43 XR 4,200,976

United States Patent [19]
Gooding

[11] 4,200,976
[45] May 6, 1980

[54] SHAVING UNITS

[75] Inventor: Trevor F. Gooding, Guildford, England

[73] Assignee: Wilkinson Sword Limited, England

[21] Appl. No.: 851,423

[22] Filed: Nov. 14, 1977

[30] Foreign Application Priority Data

Nov. 16, 1976 [GB] United Kingdom ..... 47631/76

[51] Int. Cl.[2] ..... B26B 21/06
[52] U.S. Cl. ..... 30/47; 30/50
[58] Field of Search ..... 30/32, 47, 50, 52, 346.57, 30/346.58, 346.59, 172, 304

[56] References Cited

U.S. PATENT DOCUMENTS

| | | | |
|---|---|---|---|
| 190,219 | 5/1877 | Jackson | 30/304 X |
| 206,629 | 7/1878 | Smith | 30/304 X |
| 1,558,021 | 10/1925 | Libi | 30/52 X |
| 1,825,795 | 10/1931 | Heymann | 30/50 |
| 2,195,674 | 4/1940 | Lawrence | 30/32 X |
| 2,262,476 | 11/1941 | Sussman | 30/50 X |
| 2,549,570 | 4/1951 | Bryan | 30/172 X |
| 3,660,893 | 5/1972 | Welsh | 30/52 |
| 3,940,853 | 2/1976 | Francis | 30/50 X |
| 4,016,648 | 4/1977 | Chen | 30/304 X |
| 4,063,357 | 12/1977 | Francis | 30/50 X |

*Primary Examiner*—Gary L. Smith
*Attorney, Agent, or Firm*—Leydig, Voit, Osann, Mayer & Holt, Ltd.

[57] ABSTRACT

A shaving unit comprises an open framework to which at least one razor blade is secured by its ends, the razor blade having a cutting edge spaced at a predetermined distance from one surface of the framework which provides a guard surface for the cutting edge. The framework also has supporting surfaces within the boundaries of the framework to which intermediate portions of the razor blade are attached leaving substantial lengths of the razor blade clear of the framework to permit the unimpeded passage of cut hairs and shaving soap past the cutting edge and thence through the open framework.

6 Claims, 3 Drawing Figures

SHAVING UNITS

FIELD OF THE INVENTION

This invention relates to shaving units.

By the term 'shaving unit' is meant a generally rigid member, usually of plastics material, to which is secured one or more razer blades each having one or more cutting edges, the generally rigid member providing a guard surface for the cutting edge or cutting edges of the, or each, blade.

SUMMARY OF THE INVENTION

According to the present invention a shaving unit comprises an open framework to which at least one razor blade is secured by its ends, said razer blade having a cutting edge spaced at a predetermined distance from one surface of said framework which provides a guard surface for said cutting edge, said framework also having supporting surfaces within the boundaries of said framework to which intermediate portions of said razer blade are attached leaving substantial lengths of said razor blade clear of said framework to permit the unimpeded passage of cut hairs and shaving soap past the cutting edge and thence through the open framework.

The invention also provides a shaving unit comprising a generally rigid member, at least one razor blade secured to said rigid member and having a cutting edge, said rigid member having a surface spaced from said cutting edge and providing a guard surface for the cutting edge, said razor blade being secured to said rigid member by each end and at a plurality of intermediate positions along its length, said rigid member being generally open within the region of said blade whereby there are substantial spaces around said blade to permit free passage of cut hairs and shaving soap past the cutting edge and to the rear of the shaving unit.

The invention further provides a shaving unit comprising an open framework having a front edge, a rear edge two end portions, and at least one web extending between the front edge and the rear edge intermediate said end portions, a razor blade having a cutting edge spaced at a predetermined distance from said front edge, the ends of said razor blade being secured to respective ones of said end portions and a portion of said razor blade intermediate its ends being secured to said web.

BRIEF DESCRIPTION OF THE DRAWINGS

One construction of shaving unit in accordance with the invention will now be described, by way of example only, with reference to the accompanying drawings, in which.

DESCRIPTION OF THE PREFERRED EMBODIMENT

Figure 1:
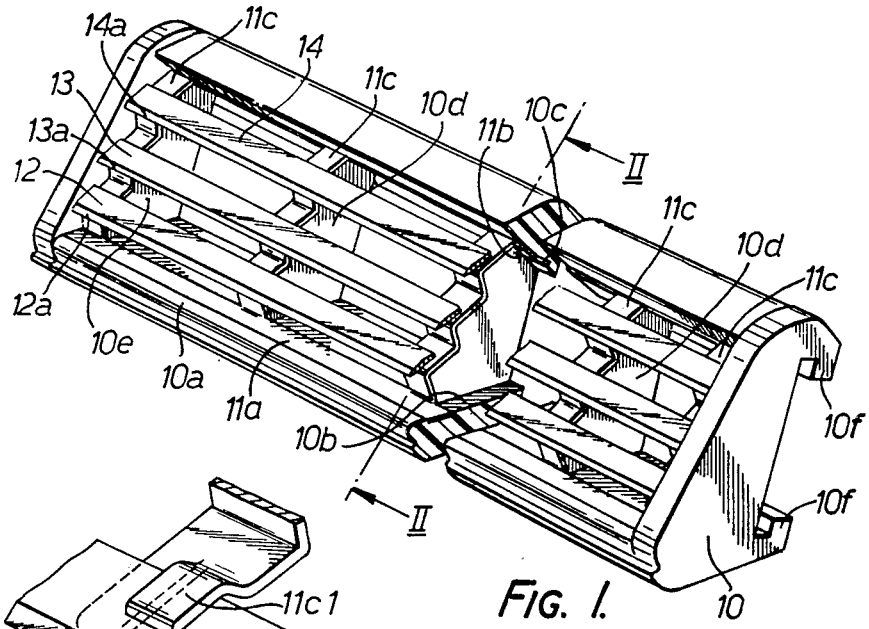
FIG. 1 is a perspective view of this construction of shaving unit.

In this construction the generally rigid member takes the form of a plastic moulding 10 in which is secured a metal blades-carrier 11 carrying three razor blades 12, 13 and 14. The moulding 10 provides a guard surface

10*a* for the cutting edge 12*a* of the blade 12, the cutting edge 12*a* being located at a predetermined spacing from the guard surface 10*a*. Blade 13 is positioned so that its cutting edge 13*a* is a predetermined distance behind cutting edge 12*a*, and blade 14 is likewise positioned with its cutting edge 14*a* predetermined distance behind cutting edge 13*a*, so that in use there will be successive cutting by the cutting edges 12*a*, 13*a* and 14*a*.

In contrast to the blades currently used in shaving units, the width of the blades 12, 13 and 14, that is the distance between the cutting edge and the rear edge of the blade which is parallel to the cutting edge, is narrow, being for example within the range of 0.8 to 2.0 millimeters, preferably 1.25 millimeters with a thickness of 0.1 of a millimeter.

The blades-carrier 11 may be a metal stamping pressed to the shape shown in the drawings to provide a front flange 11*a*, a rear flange 11*b* and five corrugated webs 11*c*. Each blade is secured to each web 11*c*, for example by welding, preferably using a form of non-contact welding such as electron-beam welding or laser welding, rather than contact welding such as spot welding which might result in distortion. Thereafter, the blades-carrier 11 is located in the moulding 10 by abutment of the leading edge of the front flange 11*a* with a step 10*b* in the inner surface of the front of the moulding 10; the blades-carrier 11 may be formed so that it snaps into position. The rear flange 11*b* of the blades-carrier 11 likewise abuts a step 10*c* in the inner surface of the rear of the moulding 10. The webs 11*c* of the blade carrier seat on correspondingly stepped webs 10*d* extending between the front and rear of the moulding and on corresponding stepped portions 10*e* (only one of which is visible) on the inside of each end face of the moulding. The shape of the carrier 11 and its location in the moulding 10 are such that the cutting edges 12*a*, 13*a* and 14*a* are in appropriate geometrical relationship with one another and with the guard surface 10*a* to provide conventional values for the effective shaving angle, the protrusion and the tangent length of each blade.

The underside of the moulding is provided with inwardly turned flanges 10*f* to provide a parallel track by which the shaving unit may be engaged with parallel rails on a handle (not shown) on which the shaving unit is mounted for use.

It will be seen that the open framework nature of the moulding 10 and blades-carrier 11, together with the space between the blades 12, 13 and 14, resulting from their narrow width, is such as to facilitate the passage of cut hairs and shaving soap through the shaving unit to the rear and to assist in the rinsing of the shaving unit. A further advantage of the narrow blades is that the range of the parameters of the shaving geometry can be greater than would be possible with wider blades accommodated in the same size of moulding. Thus, for a given width of moulding a greater tangent length is possible and the blades may lie in planes inclined to one another at a greater angle of inclination, and hence with a greater difference between their effective shaving angles than would be possible with wider blades in the same width of moulding. Alternatively, for a given width of moulding a greater number of blades can be accommodated.

It will be appreciated that although the invention has been described in a construction which utilises three razor blades, this number is not significant. Moreover, whilst there are advantages in using blades of relatively narrow width advantageous constructions can also be obtained using blades of more conventional width.

Figure 3:
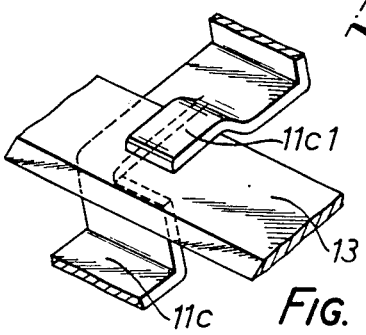
FIG. 3 is a scrap view on an enlarged scale, seen in the same direction as FIG. 1, of a part only of one blade and a part of a modified form of blades-carrier.
Figure 2:
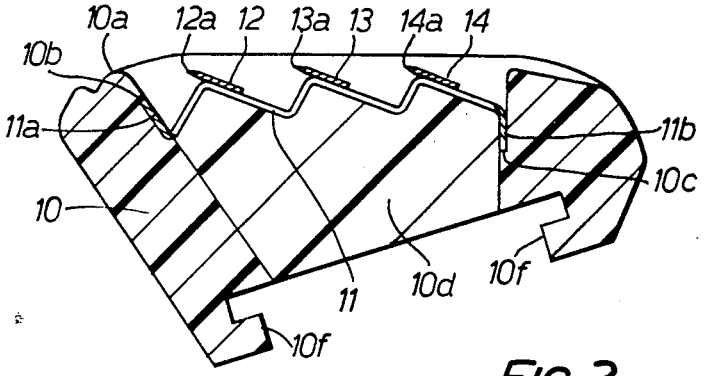
FIG. 2 is a sectional side view taken along the line II—II in FIG. 1.

It will be appreciated that many modifications are possible. Thus, as shown in FIG. 3 the webs 11*c* (only part of one shown) may be formed with tongues 11*c*1 (only one of which is shown) which overlies the blade (12, 13, 14) to provide a positive location of the cutting edge of the blade relative to the guard surface 10*a*. The tongue 11*c*1 also serves to retain the blade in position in the event of failure of the weld, or other means, by which the blade is secured in position.

Another possible modification is that instead of having the blades-carrier fitted in a plastic moulding, the blades-carrier may be formed with a leading edge which provides the guard surface. Furthermore, the blades-carrier may be formed instead, or additionally, to provide guard surfaces for the second and any subsequent cutting edges. With such constructions it is envisaged that only a handle would be required additional to the blades-carrier, and this might be permanently secured to the blades-carrier to provide a unit which would be wholly disposed after the cutting edges are not longer fit for use.

I claim:

1. A shaving unit comprising an open framework having a front edge, a rear edge, two end portions and at least one web extending between the front edge and the rear edge intermediate said end portions, a razor blade having a cutting edge spaced at a predetermined distance from said front edge, said front edge providing a guard surface for the cutting edge of said razor blade, the ends of said razor blade being secured to respective ones of said end portions and a portion of said razor blade intermediate its end being secured to said web, said web being positioned in a plane parallel to said end portions and being stepped in the area where said razor blade is secured thereto, the cutting edge of said razor blade protruding past the front edge of said step.

2. A shaving unit according to claim 1, comprising at least two blades having a width not greater than 2.0 millimeters, each having a cutting edge and the cutting edges being so positioned relative to said front edge and to one another that they provide successive cutting.

3. A shaving unit according to claim 1, comprising three uniformly spaced webs extending between said front edge and said rear edge, the respective portions of said razor blade adjacent the webs being secured thereto.

4. A shaving unit according to claim 1, wherein said open framework comprises a plastics moulding carrying a metal member, the metal member having surfaces to which said razor blade is attached.

5. A shaving unit according to claim 1, wherein each blade is of rectangular cross-section having a width within the range of about 0.8 to 2.0 millimeters and a thickness of about 0.1 millimeters.

6. A shaving unit according to claim 1, wherein said width is approximately 1.25 millimeters.

* * * * *